US010240354B2

(12) United States Patent
Rodrigues

(10) Patent No.: US 10,240,354 B2
(45) Date of Patent: Mar. 26, 2019

(54) DRYWALL LIFTING APPARATUS

(71) Applicant: Alfredo Rodrigues, York (CA)

(72) Inventor: Alfredo Rodrigues, York (CA)

(73) Assignee: Alfredo Rodrigues, York, Ontario (CA)

( * ) Notice: Subject to any disclaimer, the term of this patent is extended or adjusted under 35 U.S.C. 154(b) by 0 days.

(21) Appl. No.: 15/662,988

(22) Filed: Jul. 28, 2017

(65) Prior Publication Data

US 2019/0032344 A1 Jan. 31, 2019

(51) Int. Cl.

| | |
|---|---|
| ***E04F 21/18*** | (2006.01) |
| ***B66F 9/20*** | (2006.01) |
| ***B66F 9/12*** | (2006.01) |
| ***B66F 3/24*** | (2006.01) |

(52) U.S. Cl.

CPC ..... *E04F 21/1816* (2013.01); *B66F 3/24* (2013.01); *B66F 9/12* (2013.01); *B66F 9/205* (2013.01); *E04F 21/1822* (2013.01); *B66F 2700/057* (2013.01)

(58) Field of Classification Search

CPC ..... E04F 21/1816; E04F 21/1822; E04F 2700/057; B66F 3/214; B66F 9/12; B66F 9/205

USPC ..... 414/10–12

See application file for complete search history.

(56) References Cited

U.S. PATENT DOCUMENTS 2,750,236 A * 6/1956 Middendorf ..... B66F 11/04 182/101
2,828,870 A * 4/1958 Corley ..... B66C 7/00 414/11
2,832,479 A * 4/1958 Ottaway ..... E04F 21/1822 182/101
3,089,599 A * 5/1963 Francesco ..... E04F 21/1822 182/118
3,272,286 A * 9/1966 Leduc ..... E04F 21/1822 187/244
3,298,154 A * 1/1967 Behr ..... B66C 23/20 52/749.15
3,317,059 A * 5/1967 Higgins ..... E04F 21/1822 254/3 R
3,871,477 A * 3/1975 Kuest ..... B66F 11/04 182/129
4,120,484 A * 10/1978 Zimmer ..... E04F 21/1811 254/6 C
4,300,751 A * 11/1981 Delaney ..... B66F 19/00 254/2 R
5,322,403 A * 6/1994 Herde ..... E04F 21/1822 248/354.1
5,551,528 A * 9/1996 Vieito ..... E04F 21/1811 182/129

(Continued)

*Primary Examiner* — Lynn E Schwenningg
(74) *Attorney, Agent, or Firm* — Rowand LLP

(57) ABSTRACT

A drywall lifting apparatus is described which includes a base having one or more support features for supporting the drywall lifting apparatus on a floor. The drywall lifting apparatus further includes a hydraulic cylinder mounted, at a first portion of the hydraulic cylinder, to the base. The hydraulic cylinder has a second portion movable relative to the first portion through actuation of the hydraulic cylinder. The hydraulic cylinder also includes a drywall support coupled to the second portion of the hydraulic cylinder and a human lift coupled to the drywall support or the second portion of the hydraulic cylinder.

18 Claims, 8 Drawing Sheets

(56) References Cited

U.S. PATENT DOCUMENTS

| | | | | | |
|---|---|---|---|---|---|
| 5,944,468 | A * | 8/1999 | McBrien | E06C 7/16 | 248/410 |
| 5,992,572 | A * | 11/1999 | Gilliland | B66F 9/06 | 182/148 |
| 7,581,915 | B1 * | 9/2009 | Bristol | E04F 21/1816 | 414/11 |
| 8,931,994 | B2 * | 1/2015 | Creaney | B66F 11/04 | 182/113 |
| 2007/0104558 | A1 * | 5/2007 | Narelli | E04F 21/1822 | 414/11 |

* cited by examiner

DRYWALL LIFTING APPARATUS

FIELD

The present application relates to the construction industry and, more particularly, to a hydraulic drywall lifting apparatus that may be used to lift a drywall sheet.

BACKGROUND

Drywall, which is sometimes referred to as plasterboard, wallboard, gypsum panel, sheet rock, or gypsum board, is commonly used in the construction industry to cover interior walls and ceilings. Drywall is typically made of calcium sulphate dihydrate which may be pressed between a facer and a backer. Drywall sheets are often sold in four foot by eight foot sheets, although other dimensions are also available. Drywall is often sold in one-half inch or five-eighths inch thickness. A standard sheet of drywall can be relatively heavy and is often in the range of forty five to sixty pounds.

Due to the large size of drywall sheets and the relatively large weight of drywall sheets, working with drywall can be cumbersome and awkward. Often, numerous construction workers are required in order to handle drywall. For example, it is not uncommon for one or two workers to hold a sheet of drywall in place while another worker screws or otherwise affixes the drywall sheet in place. Labour can, therefore, contribute to a significant portion of the cost of installing drywall. Further, the large size and weight of drywall can contribute to injuries when drywall is being handled manually.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DETAIL DESCRIPTION OF EMBODIMENTS

In an aspect, a drywall lifting apparatus is described which includes a base having one or more support features for supporting the drywall lifting apparatus on a floor. The drywall lifting apparatus further includes a hydraulic cylinder mounted, at a first portion of the hydraulic cylinder, to the base. The hydraulic cylinder has a second portion movable relative to the first portion through actuation of the hydraulic cylinder. The hydraulic cylinder also includes a drywall support coupled to the second portion of the hydraulic cylinder and a human lift coupled to the drywall support or the second portion of the hydraulic cylinder. When the drywall support is moved through actuation of the hydraulic cylinder, the human lift is also moved.

Figure 1:
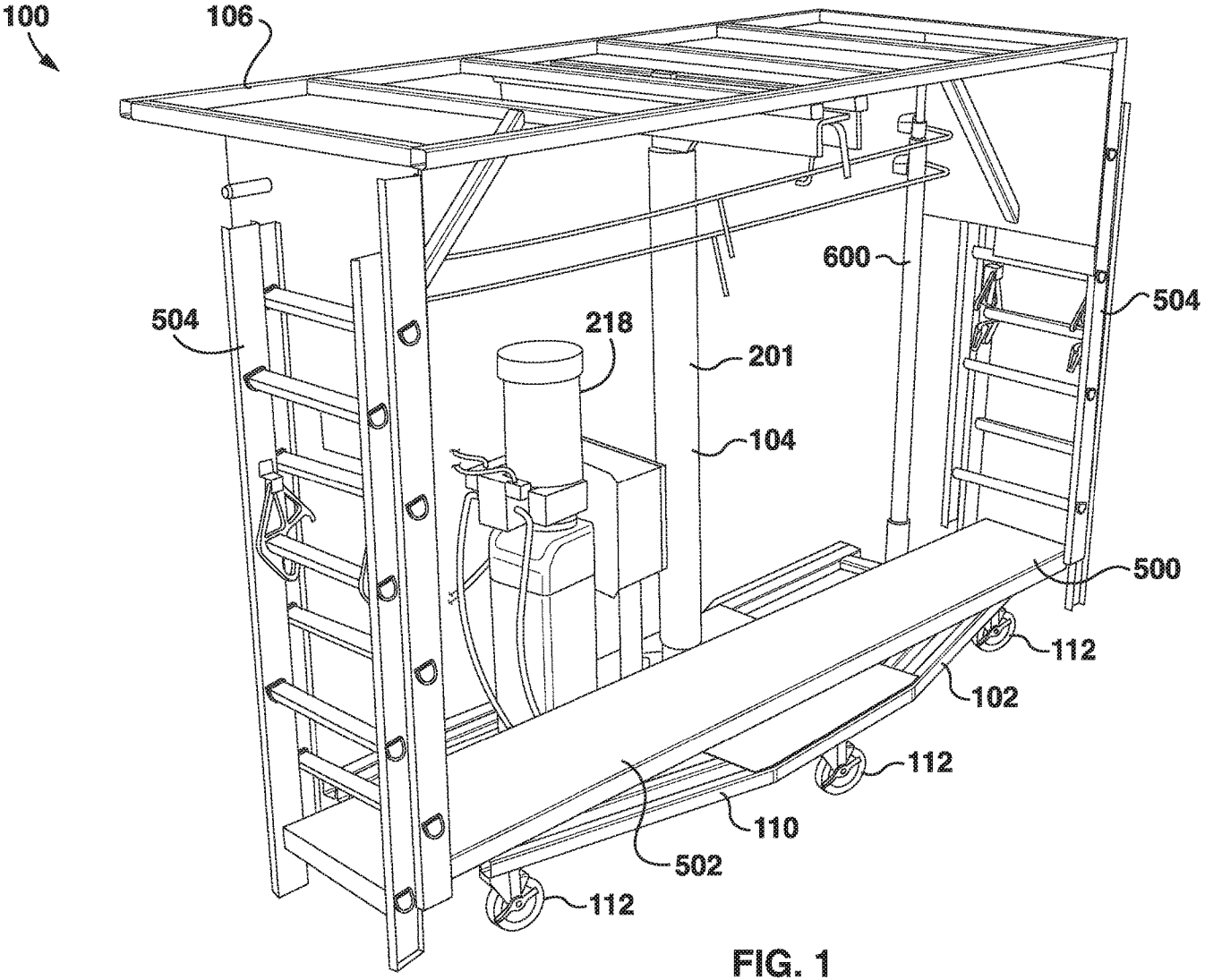
FIG. 1 shows a perspective view of a drywall lifting apparatus in a retracted configuration in accordance with example embodiments of the present disclosure.
Figure 3:
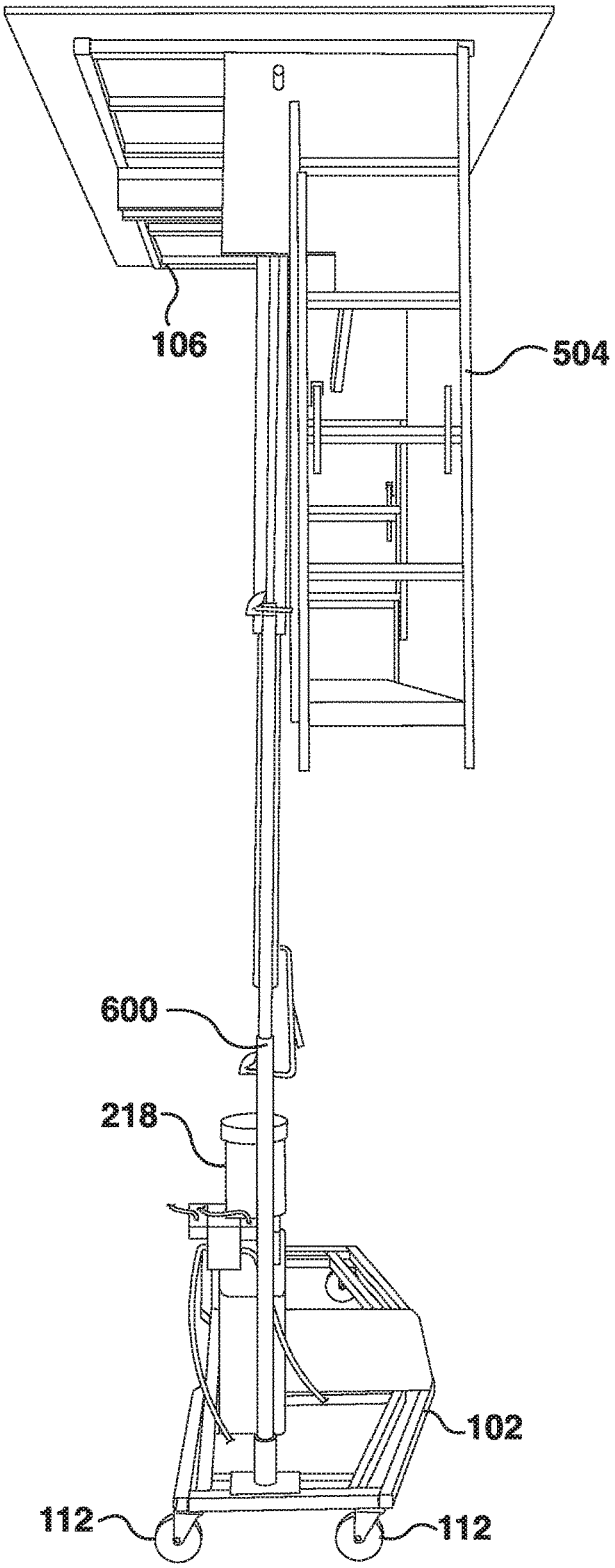
FIG. 3 shows a side view of the drywall lifting apparatus of FIG. 2 in the extended configuration.
Figure 4:
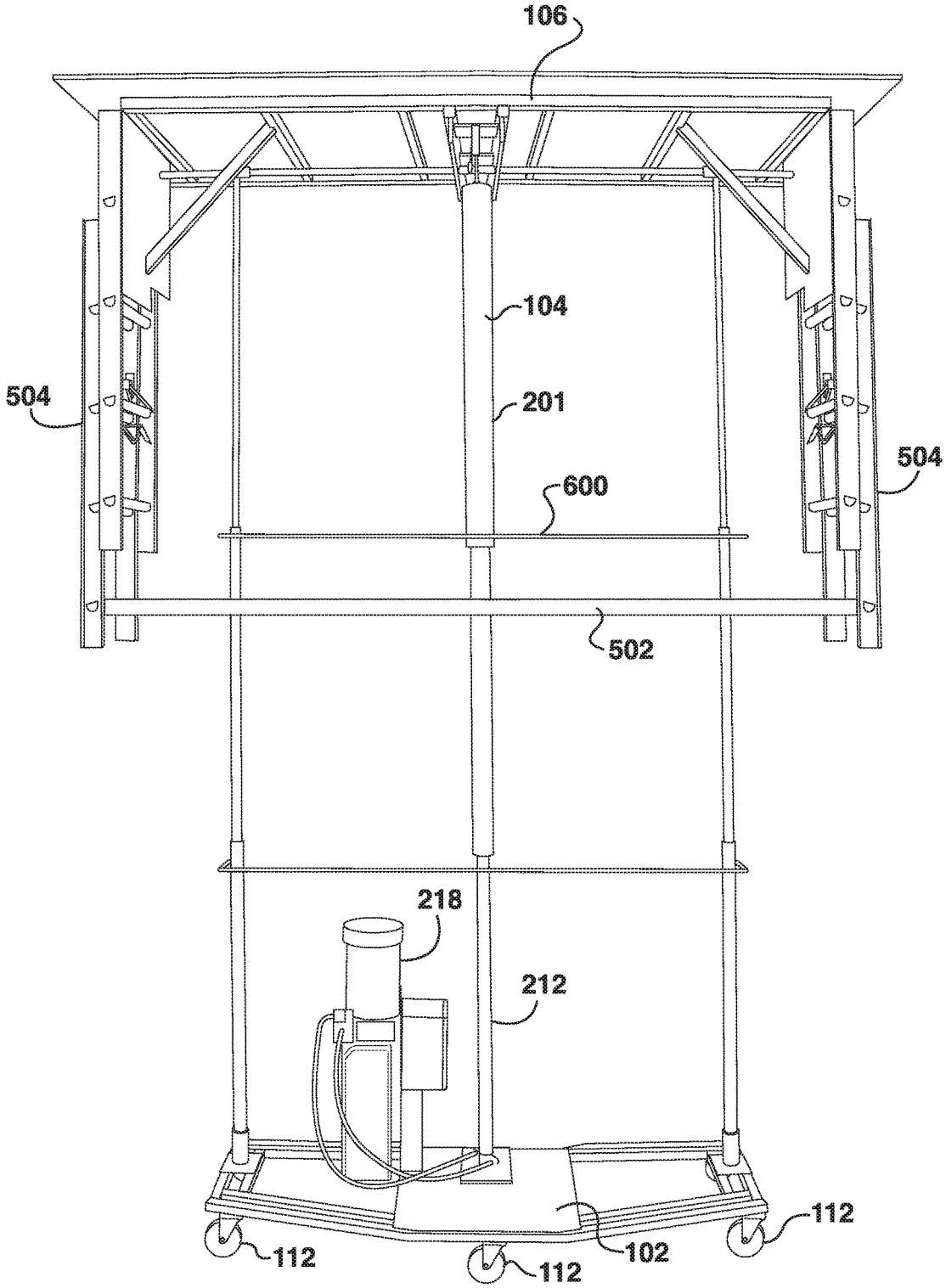
FIG. 4 shows a front elevation view of the drywall lifting apparatus of FIG. 2 in the extended configuration.

Reference will now be made to the figures which accompany this description. Referring first to FIG. 1, an embodiment of a drywall lifting apparatus 100 is illustrated. In the illustrated example of FIG. 1, the drywall lifting apparatus is in a retracted configuration. The drywall lifting apparatus may be re-configured through actuation of a hydraulic cylinder 104. More specifically, the hydraulic cylinder 104 may be actuated to extend the hydraulic cylinder 104 and cause the drywall lifting apparatus to be placed in an extended configuration in which the drywall support is further away from a base 102 of the drywall lifting apparatus. The drywall lifting apparatus 100 is illustrated as being in the extended position in FIGS. 2 to 4.

The drywall lifting apparatus 100 includes a number of components including a base 102, a hydraulic cylinder 104, and a drywall support 106. The base 102 is the lower-most portion of the drywall lifting apparatus 100. More particularly, the base 102 is configured to support other portions of the drywall lifting apparatus 100. That is, the base 102 is configured to rest upon a surface such as a floor. In the example, the base 102 includes a number of features including a frame 110, and one or more support features 112 for supporting the drywall lifting the apparatus 100 on a floor. In the example illustrated, the support features 112 are a plurality of wheels. These wheels allow this drywall lifting apparatus 100 to be easily relocated to other areas of a construction site. In at least some embodiments, one or more of the wheels may be lockable to prevent movement of the drywall lifting apparatus during use. The wheels may, in at least some embodiments, be provided at corners of the frame 110. In the example illustrated, there are six wheels (some of which are not visible in FIG. 1). However, a different number of wheels may be used in other embodiments.

The base 102 is sized to prevent tipping of the drywall lifting apparatus 100. Further, the base is sized to permit the drywall lifting apparatus 100 to travel through a standard size interior doorway. For example, a width of the base 102 may be less than thirty six inches.

Figure 2:
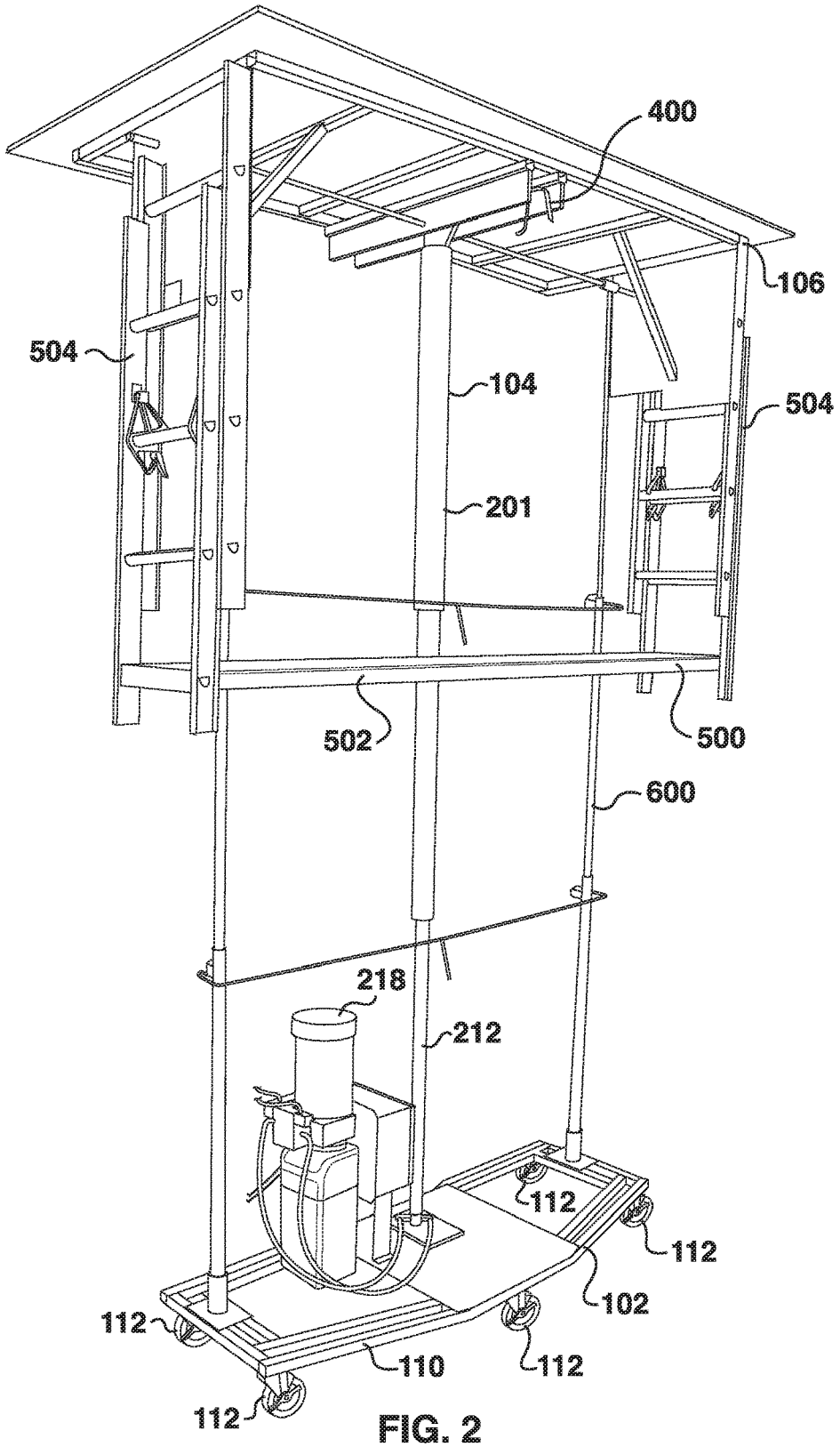
FIG. 2 shows a perspective view of the drywall lifting apparatus in an extended configuration.

A hydraulic cylinder 104 is mounted at a first portion of the hydraulic cylinder 104 to the base 102. The hydraulic cylinder 104 has a second portion movable relative to the first portion through actuation of the hydraulic cylinder 104. More particularly, the hydraulic cylinder 104 includes a cylinder barrel 201 (FIG. 4) and a piston movable therein. The piston is coupled to a piston rod 212 (FIG. 4) which is extendable from the cylinder. More particularly, as illustrated in FIG. 1, in a retracted position, the piston rod (which is not visible in FIG. 1) is substantially within the cylinder barrel. However, the hydraulic cylinder 104 may be actuated using controls provided on the drywall lifting apparatus (such controls are not illustrated in the figures) which activate a hydraulic pump 218 in order to cause the piston to move within the cylinder barrel so that the piston rod 212 extends from the cylinder barrel 201 as illustrated in FIG. 2.

The hydraulic pump 218 is hydraulically coupled to the hydraulic cylinder 104 to control movement of the hydraulic cylinder 104. The hydraulic pump 218 may be an electrically powered hydraulic pump 218 which may plug into alternating current (AC) mains power with a power cord or may be powered by a battery.

As noted above, the hydraulic cylinder 104 is mounted to the base 102 at a first portion of the hydraulic cylinder 104. In the example, the first portion of the hydraulic cylinder (which is mounted to the base 102) is the piston rod 212. That is, the piston rod 212 is mounted to the base 102 and the cylinder barrel 201 travels away from the base. In other embodiments, the first portion of the hydraulic cylinder (which is mounted to the base 102) is the cylinder barrel 201 and the hydraulic cylinder 104 can be actuated to cause the piston rod 212 to move away from the base 102. The hydraulic cylinder 104 is vertically oriented and is orthogonal to the base 102, which is generally horizontal.

Where the barrel cylinder mounts to the base 102, the piston rod 212 closer to the base when the drywall lifting apparatus 100 is in a retracted configuration than when the drywall lifting apparatus 100 is in an extended configuration.

The drywall lifting apparatus 100 also includes a drywall support 106. The drywall support provides a generally level surface where a drywall sheet (illustrated in FIG. 2 but not FIG. 1) may be received. This drywall support 106 is coupled to the second portion of the hydraulic cylinder (i.e., the portion of the hydraulic cylinder 104 that is movable with respect to the base 102). More particularly, in the example illustrated, the drywall support 106 is rotatably coupled to the cylinder barrel 201 (which is, in the illustrated example, considered the "second portion" of the hydraulic cylinder 104). In other embodiments in which the cylinder barrel 201 is coupled to the base 102, the drywall support 106 is rotatably coupled to the piston rod 212.

Figure 5:
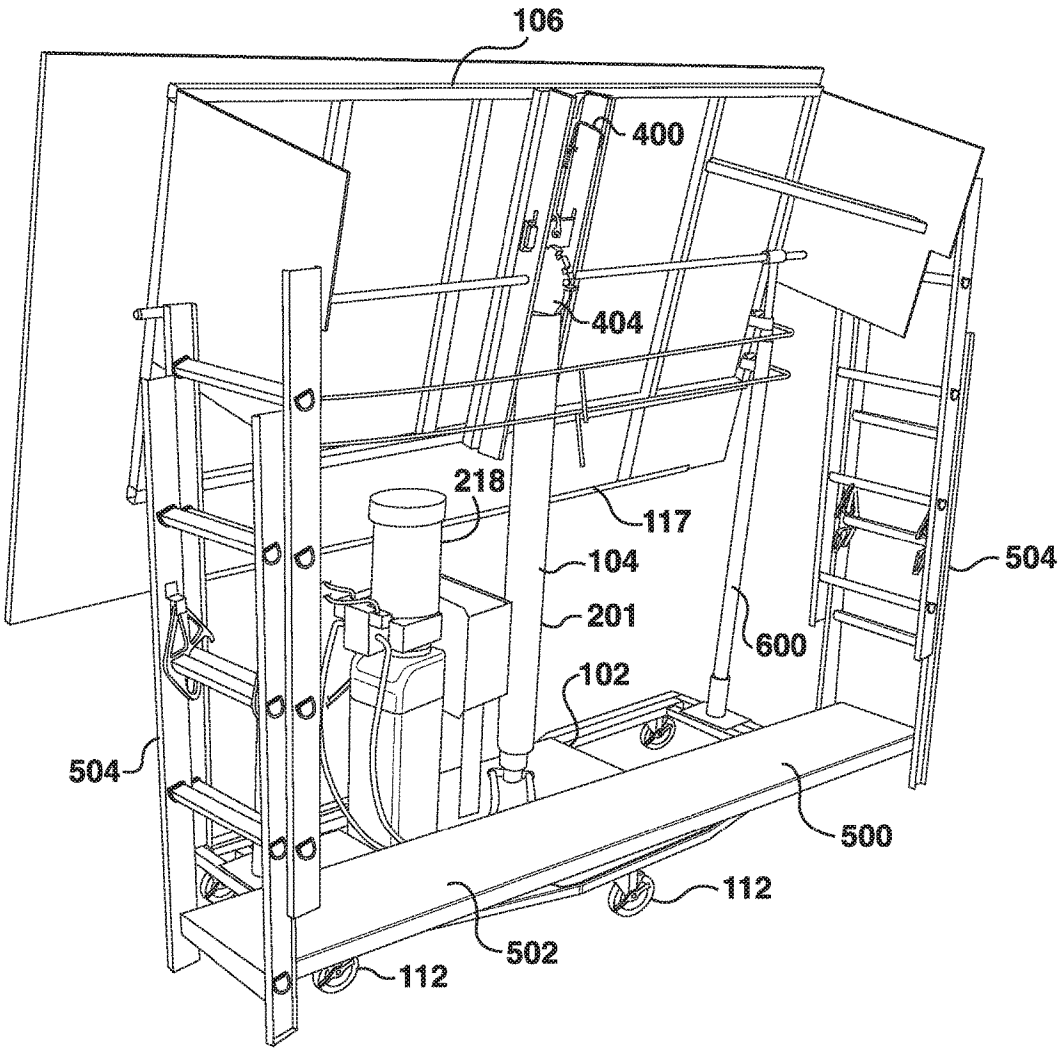
FIG. 5 shows a perspective view of the drywall lifting apparatus in an rotated configuration.
Figure 6:
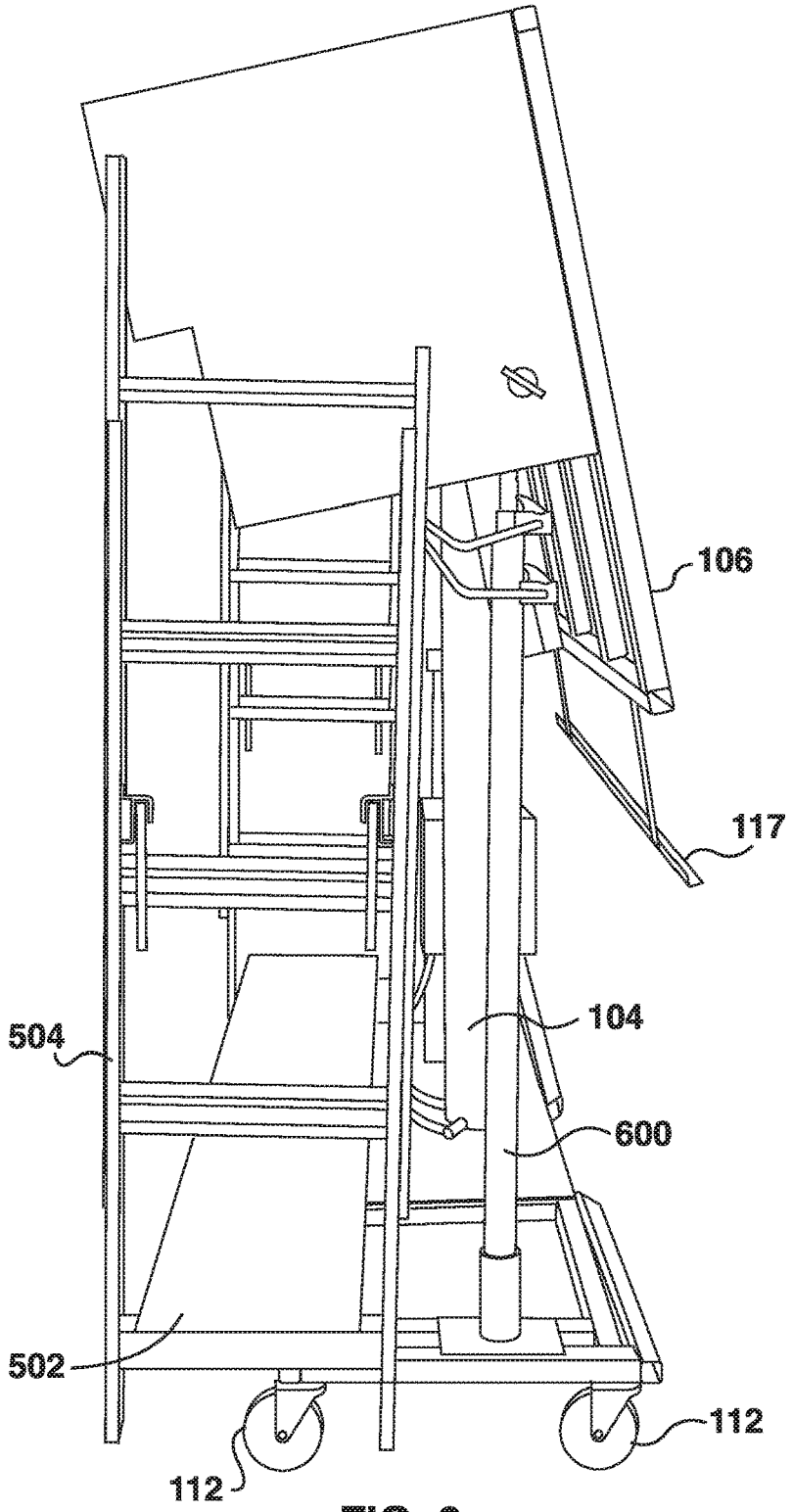
FIG. 6 shows a side view of the drywall lifting apparatus of FIG. 5 in the rotated configuration.

The rotatable coupling connecting the drywall support 106 to the hydraulic cylinder 104 permits the drywall support 106 to be rotated relative to the hydraulic cylinder 104. For example, FIGS. 5 and 6 illustrate the drywall lifting apparatus 100 in a rotated configuration in which the drywall support 106 is rotated to support drywall at a non-horizontal orientation. Thus, the rotatable coupling allows the drywall lifting apparatus 100 to be used for both horizontal placement of drywall (e.g., along a generally horizontal ceiling) and also for angled or vertical placement of drywall (e.g., along a sloped ceiling or wall or along a vertical wall). For example, the drywall lifting apparatus 100 could be used to place the drywall sheet on a generally horizontal ceiling and it could also be used to place drywall on an angled ceiling, such a vaulted ceiling. The rotatable coupling may allow the drywall support 106 to rotate to a position in which it is angled only slightly (e.g., less than a 10 degree angle with respect to the hydraulic cylinder 104) to allow drywall to be placed on a wall and may allow the drywall support 106 to rotate to a generally horizontal position (e.g., at an angle of approximately 90 degrees relative to the hydraulic cylinder 104).

Figure 7:
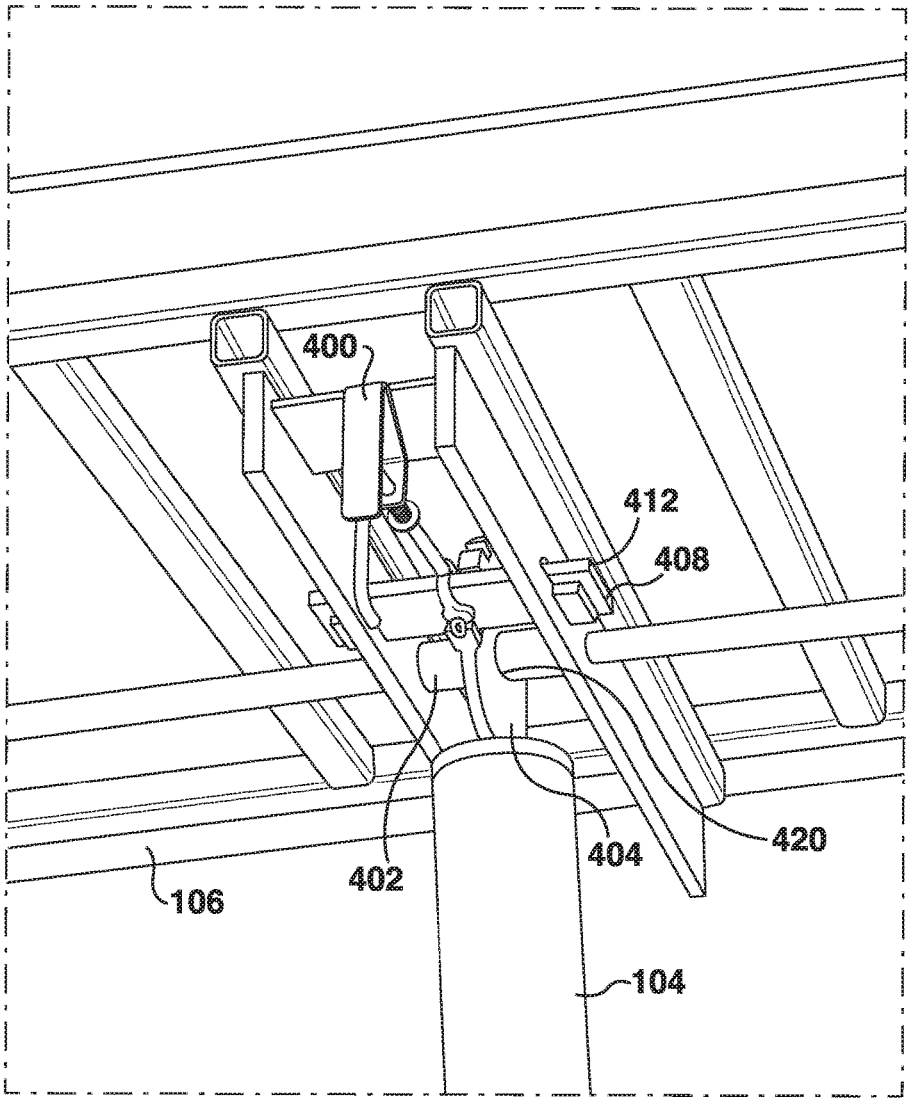
FIG. 7 is an enlarged fragmentary perspective view of a locking mechanism in accordance with example embodiments of the present disclosure.
Figure 8:
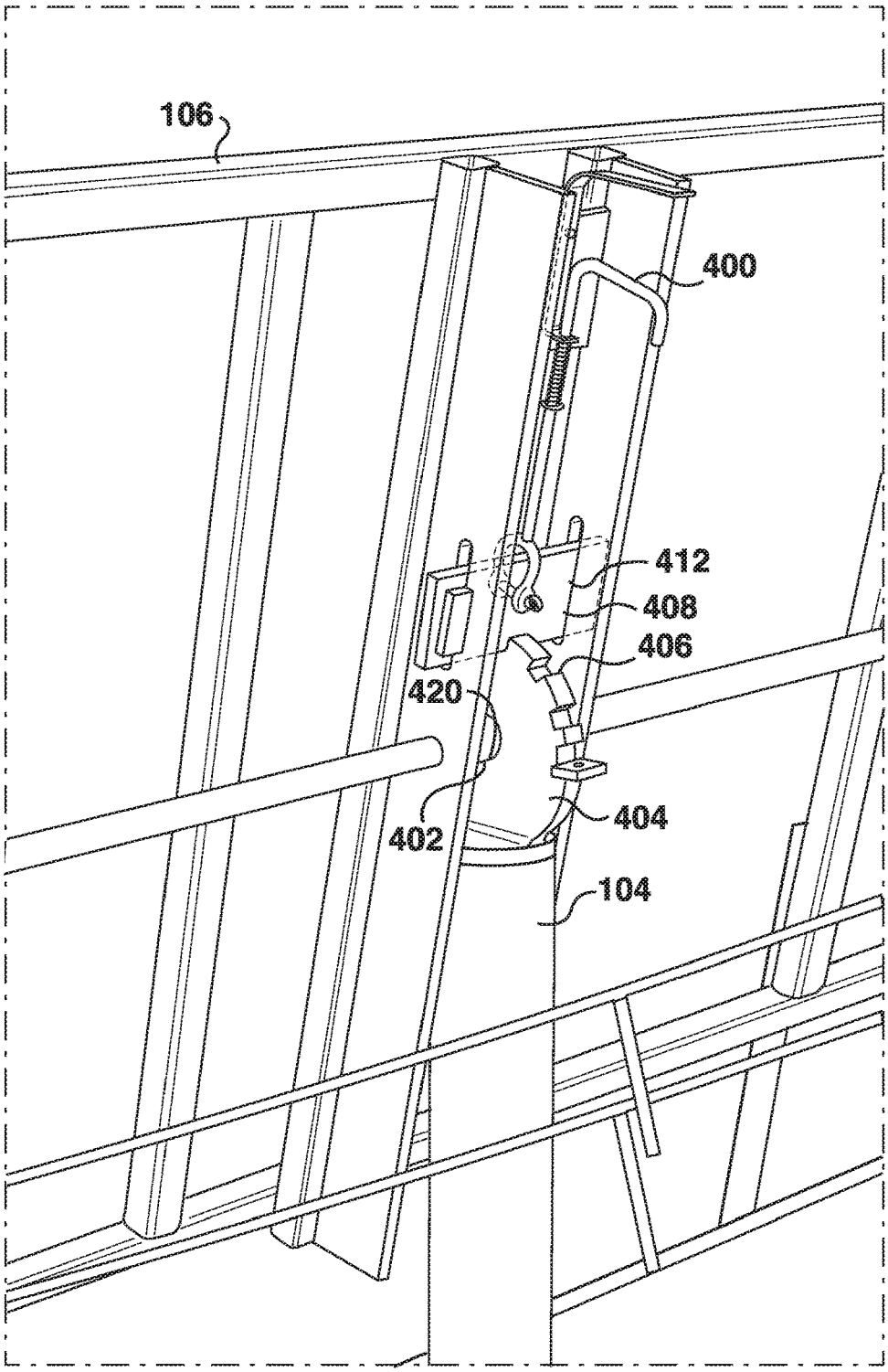
FIG. 8 is an enlarged fragmentary perspective view of a locking mechanism in accordance with example embodiments of the present disclosure.

As illustrated in FIGS. 7 and 8, a locking mechanism 400 is provided on the drywall lifting apparatus 100 to lock rotation of the drywall support relative to the cylinder barrel. That is, the drywall lifting apparatus 100 may be locked to prevent the drywall support 106 from rotating relative to the hydraulic cylinder 104. FIG. 7 illustrates the locking mechanism 400 when the drywall lifting apparatus is in first rotational position in which the drywall support 106 is generally horizontal and generally perpendicular to the hydraulic cylinder 104 and FIG. 8 illustrates the locking mechanism 400 when the drywall lifting apparatus is in a second rotational position in which the drywall support 106 is non-horizontal and is not perpendicular to the hydraulic cylinder 104.

In example of FIGS. 7 and 8, the rotatable coupling 420 includes a pin joint. More particularly, a pin 402 is placed through a hole provided in a plate 404 that is coupled to the hydraulic cylinder 104 and also in a hole that is provided on the drywall support 106. This rotatable coupling 420 allows for the rotation of the drywall support 106 relative to the hydraulic cylinder 104. In the example illustrated, the plate 404, which is attached to the hydraulic cylinder, includes a plurality of notches, voids, or other features 406 (as best illustrated in FIG. 7), which may receive a lock 412 of the locking mechanism. For example, a feature 408 provided on the locking mechanism may be movable between a position in which it interferes with the notch or recess provided on the plate and a position in which it does not interfere with the notch or recess. This protrusion 408 may be resiliently biased against the plate using a spring, for example. An operator may, however, apply force to the locking mechanism to move this feature 408 to a position in which it does not interfere with the plate 404, to allow for rotation of the drywall support 106. After rotation of the drywall support 106, the feature 408 may be placed within a notch, void or other feature to lock the drywall support 106 in its new position. The locking mechanism 400 may be provided on the drywall support 106 so that it rotates with the drywall support 106. For example, the feature 408 that interferes with the notches, voids or other features 406 that are provided on the plate 404, may rotate with the drywall support 106 so that different notches, voids or other features 406 that are provided on the plate 404 are engaged after rotation of the drywall support 106 than before such rotation.

Other type of locking mechanisms or rotatable couplings are also possible.

The drywall support 106 is generally configured to receive a standard sized sheet of drywall. For example, the drywall support 106 may be configured to receive a four by eight feet of drywall. In at least some embodiments, the drywall support 106 includes a frame. In at least one embodiment, the dimensions of the frame are less than eight feet in length and less than four feet in width. The drywall support 106 may include an edge engaging feature 117 (such as a lip or edge that extends from the generally level surface provided by the frame of the drywall support) which is configured to support the sheet of drywall when the drywall support 106 is configured to hold the sheet of drywall in a non-horizontal position (e.g., for placement of the drywall sheet on a wall). In the example illustrated, the edge engaging feature 117 is an L-shaped bracket. The L-shaped bracket receives the drywall sheet at the interior portion of the L-shaped bracket.

The edge engaging feature may be sized so is not to protrude above the sheet of drywall. Thus, in at least some embodiments, the edge engaging feature 117 has a height that is less than half an inch. That is, when the drywall support 106 is oriented in a horizontal manner in which a sheet of drywall supported by the drywall support is generally horizontal, the upper-most portion of the edge engaging feature 117 extends beyond the portion of the drywall support 106 which supports the drywall by no more than half an inch.

In some embodiments, the edge engaging feature 117 is removable from other portions of the drywall support 106. For example, in the illustrated embodiment, the edge engaging feature may be removably attached to the frame of the drywall support 106. For example, when the drywall support is oriented in a horizontal manner the edge engaging feature 117 may be removed from the frame (see, for example, FIGS. 1 to 3) whereas when it is oriented in a non-horizontal manner it may be attached to the frame with a connector (such as a bolt, pin, etc.) (see, for example, FIG. 6).

The drywall lifting apparatus includes a human lift 500 which is coupled to either the drywall support 106 or to the second portion of the hydraulic cylinder 104 (i.e., the portion of the hydraulic cylinder that moves relative to the base 102 when the hydraulic cylinder is activated). In the example illustrated, the human lift 500 is rotatably coupled to the drywall support 106 and moveable therewith. Actuation of the hydraulic cylinder 104 causes both movement of the human lift 500 and corresponding movement of the drywall support 106.

The human lift 500 provides a flat surface to provide support for a human. The flat surface (which may be referred to as a platform) is provided between the drywall support 106 and the base 102 and, as the drywall support 106 travels away from the base through actuation of the hydraulic cylinder, the human lift also travels away from the base through actuation of the hydraulic cylinder.

The human lift 500, in the example, includes a generally horizontal portion 502 coupled to the drywall support 106 by one or more coupling members 504. A flat surface is provided on the generally horizontal portion 502 and the generally horizontal portion 502 is located between the drywall support 106 and the base 102 and is generally parallel to the base 102. The coupling members 504 are generally vertical and remain vertically oriented even when the drywall support 106 is rotated. More particularly, the human lift may be rotatably coupled to the drywall support 106 so that the flat surface that is provided on the generally horizontal portion 502 remains generally horizontal and flat even when the drywall support 106 is rotated to allow drywall to be placed on a wall. The coupling members 504 may be rotatably attached to the drywall support to permit such rotation. By way of example, a pin joint may be used.

In other embodiments, instead of attaching the human lift 500 to the drywall support 106, the human lift may be coupled to the second portion of the hydraulic cylinder 104 (i.e, the portion that moves with respect to the base 102). Thus, while actuation of the hydraulic cylinder 104 causes movement of both the drywall support 106 and the human lift, rotation of the drywall support 106 will not cause rotation of the human lift 500.

The human lift 500 may provide a support surface which is aligned with an end of a drywall sheet when the drywall sheet is received in the drywall support. In the example, illustrated, the human lift includes one or more ladders. More particularly, in the example ladders act as coupling members 504 which connect the generally horizontal portion 502 to the drywall support. The ladders may be useful to allow an operator to access ends of the drywall during attachment to a wall or ceiling.

The platform or other support surface provided on the human lift may be used by an operator to access a drywall sheet that is to be installed and that has been lifted by the drywall lifting apparatus. That is, an operator may stand upon the generally horizontal portion 502 while the human lift and the drywall support are raised so that the operator standing on the human lift 500 and the drywall sheet supported by the drywall support 106 are raised together. This allows the operator to attach the drywall sheet to a ceiling or wall (e.g., using screws, etc.). To allow the operator to work comfortably, the distance between the drywall support when it is horizontally configured and the generally horizontal portion 502 is generally greater than the average adult human head height but less than the average height of a human having their arms extended. That is, the distance may allow an operator to stand comfortably without having to crouch but allows the operator to reach the drywall above them. By way of example, in some embodiments the distance may be between 6 feet and 8 feet.

In at least some embodiments, the human lift 500 is configured to allow the distance between the generally horizontal portion 502 provided on the human lift 500 and the drywall support 106 to be adjusted to accommodate operators of varying heights. In the example, such adjustment is made through the use of adjustable ladders which act as coupling members for the human lift. By extending such ladders, the distance may be increased to accommodate a taller operator.

To prevent injury to an occupant of the human lift, the drywall lifting apparatus may include one or more safety features. For example, to prevent the hydraulic cylinder from inadvertently retracting (e.g., due to a failure of the hydraulic cylinder 104, the hydraulic pump 218, etc.), a mechanical safety lock 600 may be provided on the drywall lifting apparatus. The mechanical safety lock 600 is configured to prevent the hydraulic cylinder from retracting until the mechanical safety lock is disengaged. That is, when the mechanical safety lock is engaged, the hydraulic cylinder may be prevented from retracting and an operator must actively disengage the mechanical safety lock to enable such retraction.

In the example, the mechanical safety lock includes two bars, each at a respective side of the drywall lifting apparatus. The bars are mounted to the base 102 and extend upwardly from the base 102, generally vertically. Each bar may include a plurality of asymmetric slots. The mechanical safety lock 600 further includes a pawl for engaging the asymmetric slots. The pawl is movable between a first position which engages at least one of the asymmetric slots and a second position which does not engage any of the asymmetric slots. The first position engages the safety lock and interference between the pawl and the slots prevents the hydraulic cylinder from retracting. The asymmetric nature of the slots allows the hydraulic cylinder to be further extended, even when the mechanical safety lock is engaged but prevents retraction of the hydraulic cylinder until the safety lock is disengaged. The mechanical safety lock is, in the example, a ratchet-style safety lock.

The pawl may be resiliently biased so that it naturally interferes with the slots absent an external application of force. When a user wishes to reconfigure the drywall lifting apparatus from the extended configuration to the retracted configuration, they may disengage the mechanical safety lock so that the pawl no longer interferes with slots.

Certain adaptations and modifications of the described embodiments can be made. Therefore, the above discussed embodiments are considered to be illustrative and not restrictive.

What is claimed is:

1. A drywall lifting apparatus comprising:

a base for supporting the drywall lifting apparatus on a floor;

a hydraulic cylinder mounted, at a first portion of the hydraulic cylinder, to the base, the hydraulic cylinder having a second portion movable relative to the first portion through actuation of the hydraulic cylinder;

a drywall support rotatably coupled to the second portion of the hydraulic cylinder; and a human lift moveable with the drywall support through actuation of the hydraulic cylinder and rotatably coupled to the drywall support so that a support surface provided by the human lift remains generally horizontal when the drywall support is rotated relative to the second portion of the hydraulic cylinder to allow drywall to be placed on a wall.

2. The drywall lifting apparatus of claim 1, wherein the human lift provides a flat surface adapted to support a human.

3. The drywall lifting apparatus of claim 2, wherein the flat surface is provided on the support surface.

4. The drywall lifting apparatus of claim 3, wherein the support surface is coupled to the drywall support by one or more generally vertical coupling members.

5. The drywall lifting apparatus of claim 4, wherein the coupling members include one or more ladders.

6. The drywall lifting apparatus of claim 1, wherein the human lift includes one or more ladders.

7. The drywall lifting apparatus of claim 1, wherein the support surface is aligned with an end of a drywall sheet when the drywall sheet is received in the drywall support.

8. The drywall lifting apparatus of claim 1, further comprising a locking mechanism to lock rotation of the drywall support relative to a cylinder barrel of the hydraulic cylinder.

9. The drywall lifting apparatus of claim 1, wherein the base includes a plurality of wheels for supporting the drywall lifting apparatus on the floor.

10. The drywall lifting apparatus of claim 1, wherein the hydraulic cylinder has a cylinder barrel and a piston rod which is extendable from the cylinder barrel, the piston rod coupled to the base such that the cylinder barrel moves in relation to the base under actuation of the hydraulic cylinder.

11. The drywall lifting apparatus of claim 1, further comprising a mechanical safety lock to prevent the hydraulic cylinder from retracting until the mechanical safety lock is disengaged.

12. The drywall lifting apparatus of claim 1 wherein the human lift is narrower than the drywall support providing space for the hydraulic cylinder to extend beyond the support surface to the drywall support.

13. A drywall lifting apparatus comprising:

a base for supporting the drywall lifting apparatus on a floor;

a hydraulic cylinder mounted, at a first portion of the hydraulic cylinder, to the base, the hydraulic cylinder having a second portion movable relative to the first portion through actuation of the hydraulic cylinder;

a drywall support coupled to the second portion of the hydraulic cylinder; and a human lift coupled to the drywall support or the second portion of the hydraulic cylinder, wherein the human lift is narrower than the drywall support providing space for the hydraulic cylinder to extend beyond a support surface of the human lift to the drywall support;

wherein the drywall support is rotatably coupled to the second portion of the hydraulic cylinder; and wherein the human lift is moveable with the drywall support through actuation of the hydraulic cylinder and rotatably coupled to the drywall support so that the support surface provided by the human lift remains generally horizontal when the drywall support is rotated relative to the second portion of the hydraulic cylinder to allow drywall to be placed on a wall.

14. The drywall lifting apparatus of claim 13, wherein the human lift includes one or more ladders.

15. The drywall lifting apparatus of claim 13, wherein the support surface is aligned with an end of a drywall sheet when the drywall sheet is received in the drywall support.

16. The drywall lifting apparatus of claim 13, wherein the hydraulic cylinder has a cylinder barrel and a piston rod which is extendable from the cylinder barrel, the piston rod coupled to the base such that the cylinder barrel moves in relation to the base under actuation of the hydraulic cylinder.

17. The drywall lifting apparatus of claim 13, further comprising a mechanical safety lock to prevent the hydraulic cylinder from retracting until the mechanical safety lock is disengaged.

18. The drywall lifting apparatus of claim 13, wherein the base includes a plurality of wheels for supporting the drywall lifting apparatus on the floor.

* * * * *